US007212736B2

(12) United States Patent
Nelson et al.

(10) Patent No.: US 7,212,736 B2
(45) Date of Patent: May 1, 2007

(54) INFRARED CURING DEVICE HAVING ELECTRICALLY ACTUATED ARM AND SYSTEM AND METHOD THEREWITH

(75) Inventors: James S. Nelson, Mounds View, MN (US); Sam L. Villella, Clermont, FL (US); Chad T. Lameyer, Stacy, MN (US)

(73) Assignee: Illinois Tool Works Inc., Glenview, IL (US)

( * ) Notice: Subject to any disclaimer, the term of this patent is extended or adjusted under 35 U.S.C. 154(b) by 12 days.

(21) Appl. No.: 11/144,978

(22) Filed: Jun. 3, 2005

(65) Prior Publication Data

US 2006/0291829 A1 Dec. 28, 2006

(51) Int. Cl.
*F26B 3/30* (2006.01)

(52) U.S. Cl. ..... 392/412; 219/200

(58) Field of Classification Search ..... None
See application file for complete search history.

(56) References Cited

U.S. PATENT DOCUMENTS 4,771,728 A 9/1988 Bergman, Jr.
4,907,533 A 3/1990 Nelson et al.
4,908,231 A 3/1990 Nelson et al.
4,943,447 A 7/1990 Nelson et al.
5,050,232 A 9/1991 Bergman et al.
5,306,359 A 4/1994 Eppeland et al.
5,318,280 A 6/1994 Bannick
5,335,308 A 8/1994 Sorensen
5,485,985 A 1/1996 Eppeland et al.
5,551,670 A 9/1996 Heath et al.
5,605,222 A 2/1997 Huberty et al.
5,650,026 A 7/1997 Ganyo et al.
D418,211 S 12/1999 Lundin
D457,228 S 5/2002 Lundin
2003/0132223 A1* 7/2003 Ueno ..... 219/520
2004/0136700 A1 7/2004 Yackel

* cited by examiner

*Primary Examiner*—Thor S Campbell
(74) *Attorney, Agent, or Firm*—Fletcher Yoder

(57) ABSTRACT

In certain embodiments, the present technique provides a system for curing a surface material disposed on a vehicle. The system includes an electrically actuated arm having an arm structure, a motorized drive coupled to the arm structure, and an actuator communicatively coupled to the motorized drive. The system also has a radiative curing device coupled to the arm structure, and a curing controller communicatively coupled to the radiative curing device.

21 Claims, 12 Drawing Sheets

INFRARED CURING DEVICE HAVING ELECTRICALLY ACTUATED ARM AND SYSTEM AND METHOD THEREWITH

BACKGROUND OF THE INVENTION

The present technique relates generally to finishing systems and, more particularly, to industrial finish curing systems. In specific, a system and method is provided for automatically moving an arm assembly to position a mounted curing device in a desired curing position based on the height of a particular target object, such as differently sized vehicles.

Finish coatings, such as paint, are often applied to a product and subsequently cured via heating devices. In many finishing systems, the product is placed in a curing room, where heat is flowed through the room to dry the finish coatings that were applied to the product. Unfortunately, these curing rooms are costly in terms of space consumption within the facility, and the curing rooms are incapable of focusing heat on specific regions of the product.

In certain applications, a heater is coupled to a mechanical arm, which is manually moved to a desired position relative to the target product. In this manner, heat can be focused on specific regions of the product. For example, a user may grasp a portion of the arm, and then push or pull the arm to orient the heater over a surface of the target product. Unfortunately, the size, shape, weight, position, or complexity of the target object, the arm, or the heater often complicates the user's ability to orient the heater in the desired position relative to a surface material to be cured.

Accordingly, a technique is needed for moving the arm to the desired orientation despite the size, shape, weight, position, or complexity of the target object, the arm, or the heater.

SUMMARY OF THE INVENTION

In certain embodiments, the present technique provides a system for curing a surface material disposed on a vehicle. The system includes an electrically actuated arm having an arm structure, a motorized drive coupled to the arm structure, and an actuator communicatively coupled to the motorized drive. The system also has a radiative curing device coupled to the arm structure, and a curing controller communicatively coupled to the radiative curing device.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

As discussed in detail below, embodiments of an electrically actuated arm are used to position a curing device, such as an infrared heating lamp, in a desired orientation to heat, dry, or generally cure a surface material (e.g., paint, primer, clear coat, decals, stain, and other finish coatings) on a variety of target objects (e.g., vehicles, furniture, fixtures, and other products). For example, instead of placing a product in a heated room, the arm mounted curing device is moved in a desired pattern over the surface of the product to cure the surface material. In certain embodiments, the electrically actuated arm includes a motorized drive coupled to a standard-sized rotatable arm. The motorized drive, for example, includes an electric motor coupled to a worm shaft, which rotates against mating threads to move a linear drive structure in an expansive or contractive direction relative to the rotatable arm. Alternatively, the electrically actuated arm may include other drive mechanisms, such as hydraulics, pneumatics, cable and pulley systems, and so forth. Embodiments of the electrically actuated arm also include a control device, such as an electrical/mechanical switch (e.g., a toggle switch), positional buttons (e.g., up and down buttons), a touch screen unit, a wireless remote control, a wired remote control, or another suitable device configured to actuate the motorized drive. In addition, certain embodiments of the electrically actuated arm include a height-adjustable end mechanism, which enables multiple vertical positions of the curing device at the end of the electrically actuated arm. This height adjustment is particularly useful for accommodating differently sized products, such as small, medium, and large sized vehicles.

Figure 1:
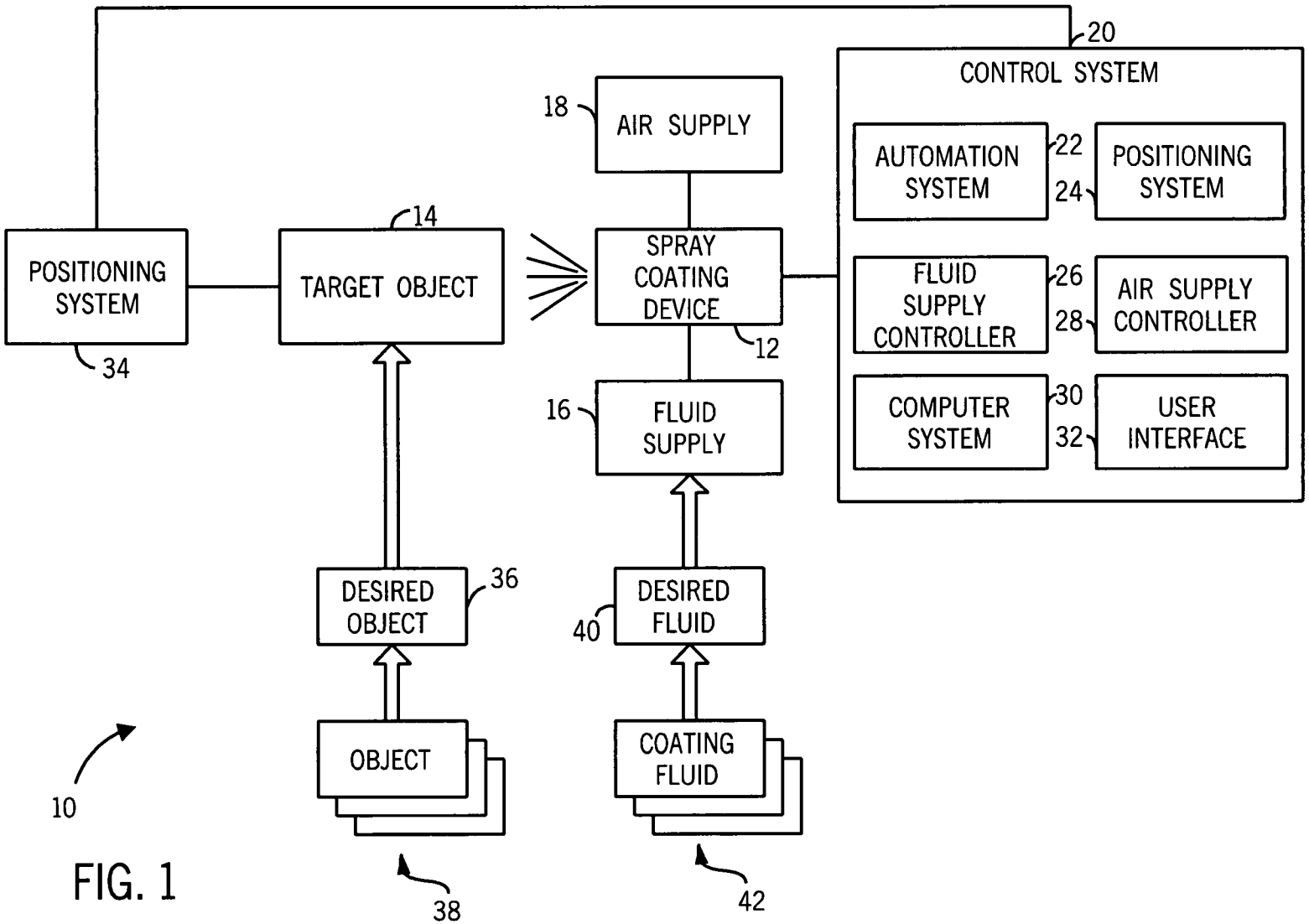
FIG. 1 is a diagram illustrating an exemplary finishing system in accordance with embodiments of the present technique.

FIG. 1 is a flow chart illustrating an exemplary finishing system 10, which comprises a spray coating device 12 for applying a desired coating to a target object 14. For example, the spray coating device 12 may comprise an air atomizer, a rotary atomizer, an electrostatic atomizer, or any other suitable spray formation mechanism. The spray coating device 12 may be coupled to a variety of supply and control systems, such as a material supply 16 (e.g., a fluid or powder), an air supply 18, and a control system 20. The control system 20 facilitates control of the material and air supplies 16 and 18 and ensures that the spray coating device 12 provides an acceptable quality spray coating on the target object 14. For example, the control system 20 may include an automation system 22, a positioning system 24, a material supply controller 26, an air supply controller 28, a computer system 30, and a user interface 32. The control system 20 also may be coupled to a positioning system 34, which facilitates movement of the target object 14 relative to the spray coating device 12. For example, the positioning system 34 may comprise an assembly line, a hydraulic lift, a robotic arm, and a variety of other positioning mechanisms controlled by the control system 20. Accordingly, the finishing system 10 may provide a computer-controlled spray pattern across the surface of the target object 14.

The finishing system 10 of FIG. 1 is applicable to a wide variety of applications, fluid coating materials, powder coating materials, target objects, and types/configurations of the spray coating device 12. For example, a user may select a desired object 36 from a variety of different objects 38, such as different material and product types. The user also may select a desired material 40 from a plurality of different materials 42, which may include different coating types, colors, textures, and characteristics for a variety of materials such as metal and wood. For example, the desired material 40 may comprise a powder coating material, a fluid coating material (e.g., a paint), a filler material (e.g., body filler), and so forth. In one exemplary embodiment, the finishing system 10 may be incorporated into a vehicle assembly line or a vehicle repair facility.

Figure 2:
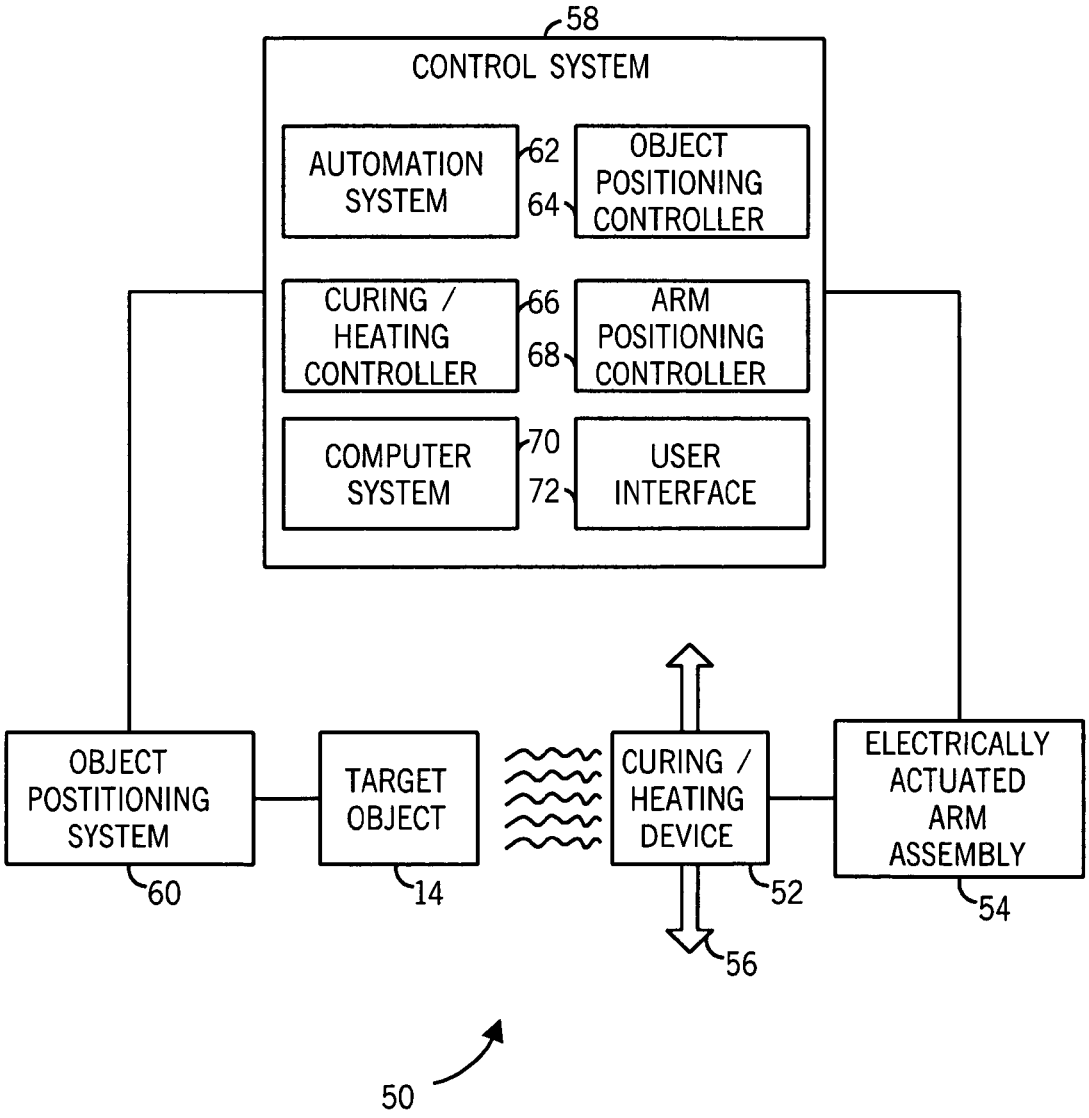
FIG. 2 is a diagram illustrating an exemplary finish curing system in accordance with embodiments of the present technique.

FIG. 2 is a flow chart illustrating an exemplary finish curing system 50, which comprises a curing device 52 for curing a desired material applied to the target object 14. For example, the curing device 52 may comprise one or more heating devices, drying devices, or other suitable curing mechanisms. In certain embodiments discussed below, the curing device 52 includes one or more radiative curing devices, such as infrared lamps, which radiate energy (e.g., electromagnetic energy) to cure coatings or applications of paint, filler materials, decals, stain, or other surface materials on the target object 14. In this exemplary embodiment, the curing device 52 is coupled to an electrically actuated arm assembly 54, which automatically positions the curing device 52 in a desired curing position relative to the target object 14. For example, in certain embodiments discussed in detail below, the electrically actuated arm assembly 54 comprises an electric motor coupled to a movable arm, a drive (e.g., a worm gearing mechanism) coupled to the electric motor, and a control unit (e.g., an electronic user control) coupled to the electric motor. The outer end or peripheral portion of the electrically actuated arm assembly 54 also has an adjustable height mechanism 56, which adapts the vertical range of the electrically actuated arm assembly 54 to the geometry of the particular target object 14. For example, the adjustable height mechanism 56 is movable between high and low positions to accommodate target objects (e.g., cars, trucks, boats, airplanes, or other vehicles) ranging from large-sized to small-sized.

The finish curing system 50 also may include a variety of positioning and control systems (e.g., manual and/or automatic), such as control system 58 and object positioning system 60. The control system 58 ensures that the desired material is efficiently and optimally cured onto the target object 14. For example, the control system 58 may include an automation system 62, an object positioning controller 64 coupled to the object positioning system 60, a curing/heating controller 66 coupled to the curing/heating device 52, an arm positioning controller 68 coupled to the electrically actuated arm assembly 54, a computer system 70, and a user interface 72.

As illustrated in FIG. 2, the control system 58 and its various components control aspects of the electrically actuated arm assembly 54 and the curing/heating device 52. For example, embodiments of the control system 58 include a variety of hardware and software to execute various curing cycles, movements of the target object 14, and movements of the arm assembly 54 in desired patterns, times, and orientations between the curing/heating device 52 and the surface of the target object 14. More specifically, certain embodiments of the curing/heating controller 66 include one or more processors, memory, user interfaces or controls (e.g., display, mouse, keyboard, remote control unit, directional control buttons or switches, etc.), computers, networks, wireless communication devices, and code configured to effectuate a desired curing cycle. The curing cycle, for example, may include a temperature profile that varies over time based on a particular surface material and, also, the desired characteristics or results that are to be achieved by curing the particular surface material. The curing cycle also may include a positional pattern for moving the curing/heating devices 52 relative to the surface of the target object 14.

In addition, the object positioning system 60 facilitates movement of the target object 14 relative to the curing device 52. For example, the object positioning system 60 may comprise a manual positioning mechanism, an assembly line, a hydraulic lift, a robotic arm, and a variety of other positioning mechanisms operated by the control system 58. Using these controls features, the finish curing system 50 can automatically cure/dry the desired material to provide a cured surface material with the desired characteristics. For example, the present technique may produce a uniquely cured powder coating, fluid spray coating, filler material, adhesively-backed decal, or any other such material applied to the surface.

Figure 3:
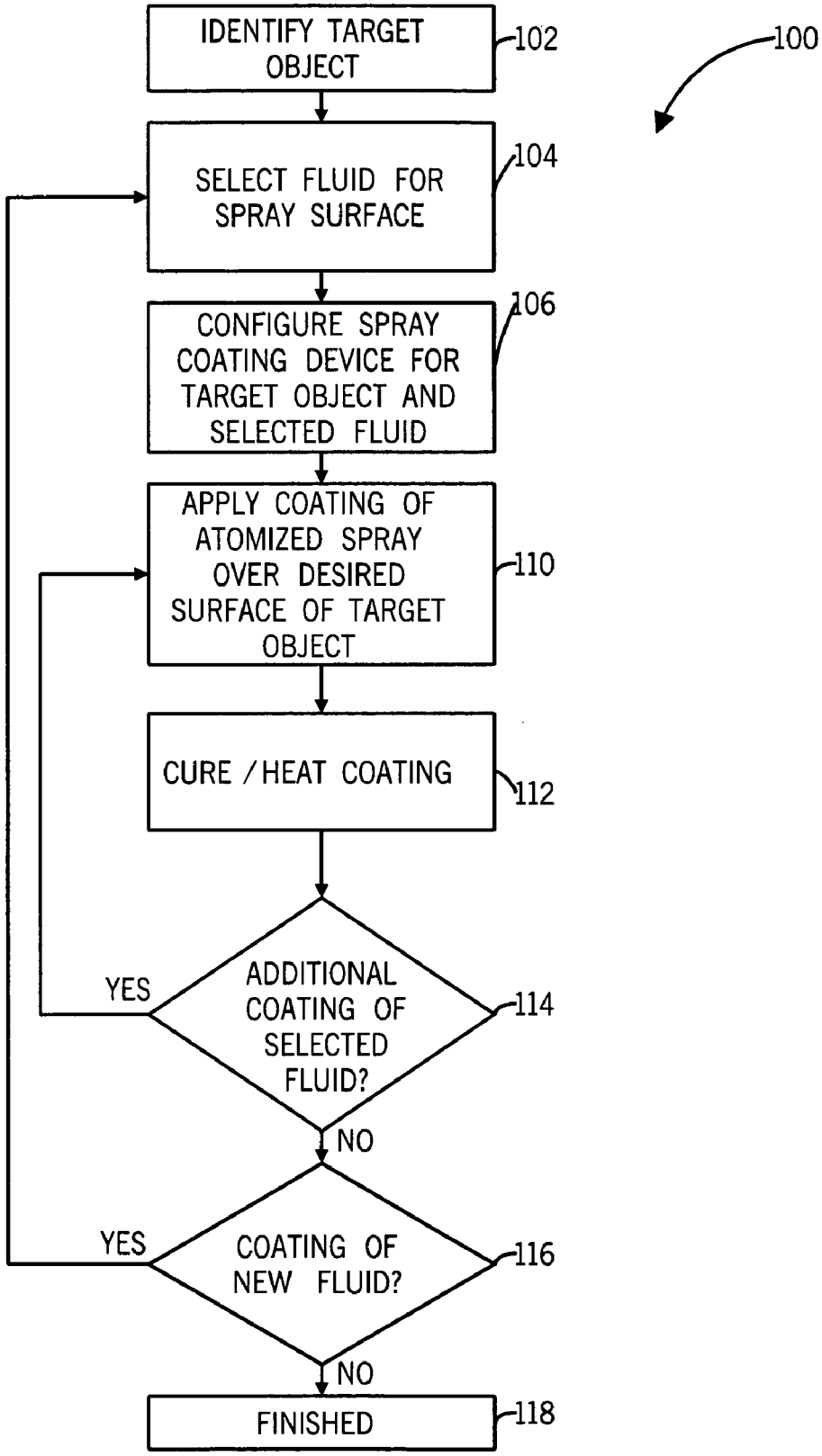
FIG. 3 is a flow chart illustrating an exemplary finishing and curing process of the systems illustrated in FIGS. 1 and 2 in accordance with embodiments of the present technique.

FIG. 3 is a flow chart of an exemplary finishing process 100 for applying and curing a desired material to the target object 14. As discussed above, the desired material may be a powder coating material, a fluid coating material, a filler material, or any other suitable surface applied material, including paints, varnishes, clear coats fillers, top coats, and so forth. As illustrated, the process 100 proceeds by identifying the target object 14 for application of the desired material (block 102). The process 100 then proceeds by selecting the desired material 40 for application to a surface of the target object 14 (block 104). A user may then proceed to configure the application device, the identified target object 14, and desired material (block 106). If the device is a spraying device, the process 100 then proceeds to create an atomized spray of the selected fluid or powder. The user may then apply the desired material over the desired surface of the target object 14 (block 110). The process 100 then proceeds to cure/dry the desired material that was applied over the desired surface (block 112). For example, the curing block 112 may include executing a curing cycle to emit a desired level of heat or radiation (e.g., infrared radiation) toward the desired material over a desired time period. The heat/radiation profile may be constant, stepped, or curved based on the desired curing time and material characteristics to be achieved by the curing cycle. The curing cycle also can include a positional pattern of movement for moving the curing device relative to the surface. If the user desired an additional application of the desired material at query block 114, then the process 100 proceeds through blocks 110 and 112 to provide another application of the desired material. If the user does not desire an additional material application at query block 114, then the process 100 proceeds to query block 116 to determine whether the user desires a new material application. If a new material application is desired at query block 116, then the process 100 proceeds through blocks 104–114 using a new selected material. If the user does not desire a new material application at query block 116, then the process 100 is finished at block 118.

Figure 4:
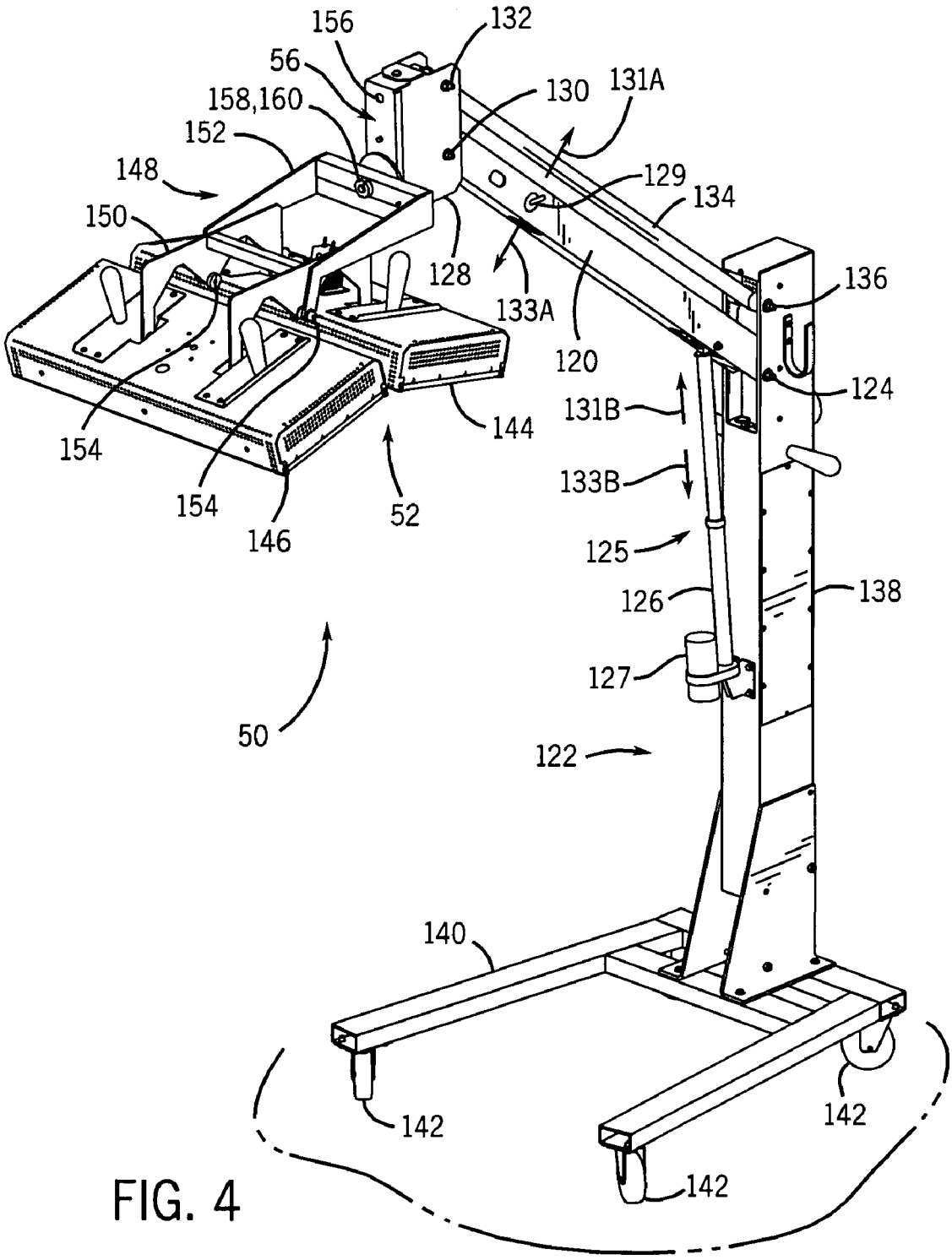
FIG. 4 is a perspective view of an electrically actuated arm assembly, curing device, and adjustable height mechanism of the finish curing system illustrated in FIG. 2 in accordance with embodiments of the present technique.

As described in further detail below, the foregoing systems 10 and 50 and the finishing process 100 may utilize a variety of positioning assemblies, such as the electrically actuated arm assembly 54. FIG. 4 is a perspective view of an exemplary embodiment of the finish curing system 50 having the curing device 52 coupled to the electrically actuated arm assembly 54 via the adjustable height mechanism 56. As illustrated, the electrically actuated arm assembly 54 comprises an arm structure 120 rotatably coupled to an arm support 122 via a pivot joint 124.

Although the arm structure 120 is illustrated as a single straight arm, the electrically actuated arm assembly 54 may have a multi-section arm and any suitable straight or curved geometry. The arm structure 120 also may have a variety of positioning control linkages to facilitate a desired vertical, lateral, and angular position. For example, the illustrated electrically actuated arm assembly 54 has a motorized drive 125 extending between the arm support 122 and the arm structure 120, such that the arm structure 120 may be moved vertically in a range extending between minimum and maximum vertical positions. In the illustrated embodiment, the motorized drive 125 includes a linear drive 126 coupled to an electric motor 127, which is electrically coupled to an electrical actuator or position control switch 129. If the actuator or switch 129 is moved upward as indicated by arrow 131A, then the electric motor 127 is actuated to power the linear drive 126 in the upward direction as indicated by arrow 131B. Similarly, if the actuator or switch 129 is moved downward as indicated by arrow 133A, then the electric motor 127 is actuated to power the linear drive 126 in the downward direction as indicated by arrow 133B. In certain embodiments, the linear drive 126 comprises a worm gearing mechanism, such as a male threaded shaft disposed within a female threaded shaft as discussed in further detail below. In other embodiments, the linear drive 126 includes a hydraulic drive assembly having a hydraulic chamber, a hydraulic pump, and other suitable components. The actuator or switch 129 also can include a variety of control devices, such as separate up and down buttons, an electronic control panel, a wireless remote control unit, a wired remote control unit, or a combination thereof.

The electrically actuated arm assembly 54 also may have a variety of rotation-inducing mechanisms coupled to the arm structure 120, such that the arm structure 120 can be positioned in a desired angular position. In the illustrated embodiment, the electrically actuated arm assembly 54 has an adjustable end structure 128 rotatably coupled to the arm structure 120 at a pivot joint 130. At an adjacent pivot joint 132, the adjustable end structure 128 is rotatably coupled to an end positioning linkage 134 that is rotatably coupled to the arm support 122 via a pivot joint 136. As described with reference to FIG. 2, each of the foregoing linkages may comprises a variety of manual or automatic motion-inducing mechanisms, such as a hydraulic mechanism, a pneumatic mechanism, a geared mechanism, a motorized mechanism, a cable and pulley mechanism, or any other suitable mechanism.

The illustrated arm support 122 includes a vertical support 138 extending from a base structure 140, which has a plurality of wheels 142. However, the arm support 122 may comprise any suitable fixed or movable structure depending on the particular application. For example, the arm support 122 may be bolted or generally secured to a wall, a floor, a vehicle, a trailer, or any other suitable vertical, horizontal, or angled mounting structure. The arm support 122 also may have a manual or automatic positioning system, such as a rotational or linear positioning system to move the arm support 122 adjacent the target object 14. For example, the arm support 122 may be coupled to a rail structure along a floor, wall, or ceiling. In addition, the rail structure may include a powered drive mechanism to push or pull the arm support 122. By further example, the arm structure may be expandable and contractible in a vertical direction, such that the height of the arm support 122 can be varied to accommodate a particular curing application. Again, a powered drive mechanism can be included to facilitate this vertical expansion and contraction of the arm support 122. Accordingly, the electrically actuated arm assembly 54 can position the curing device 52 in a desired curing position relative to the target object 14.

The curing device 52, as illustrated in FIG. 4, includes a pair of heating/drying devices 144 and 146. The heating/drying devices 144 and 146 can have any suitable drying mechanism, such as conductive, convective, and/or radiative heat transfer mechanisms, which cure a fluid coating, a powder coating, a filler, an adhesive, and so forth. For example, the heating/drying device 144 and 146 may comprise a fuel combustion heater, an electrical resistance heater, or a radiation heating mechanism. In the illustrated embodiment, the heating/drying devices 144 and 146 include a pair of infrared lamps. The heating/drying devices 144 and 146 are mounted to a head structure 148, which is coupled to the adjustable end structure 128 via the adjustable height mechanism 56. The illustrated head structure 148 has a fork-shaped extension 150 rotatably coupled to an E-shaped support 152 via a pivot joint 154. However, any suitable multi-section or integral support structure or yoke is within the scope of the present technique. The head structure 148 also may have a manual or automatic positioning system to pivot the E-shaped support 152 about the pivot joint 154.

At the adjustable end structure 128, the adjustable height mechanism 56 of FIG. 4 provides a high mounting position 156 and a low mounting position 158 for the head structure 148. In this exemplary embodiment, the head structure 148 is interchangeably and selectively mountable at either one of the high and low mounting positions 156 and 158 via a fastener 160. For example, the high and low mounting positions 156 and 158 may comprise female threads that can receive male threads of the fastener 160. The high and low mounting positions 156 and 158 also may include mechanical latches, hooks, or other releasable and interchangeable mount structures. The illustrated fastener 160 also may operate as a pivot joint for rotating the head structure 148 relative to the arm structure 120. A manual or automatic positioning system may then be coupled to the foregoing pivot joint to facilitate rotation of the head structure 148.

Alternatively, the adjustable height mechanism 56 may have a single mounting mechanism, such as an offset mounting structure, while the adjustable height mechanism 56 is reversibly and interchangeably mountable to the adjustable end structure 128. For example, the adjustable height mechanism 56 may be released, swiveled about a pivot joint, and then resecured to the adjustable end structure 128. The adjustable height mechanism 56 also may be detached, rotated 180 degrees, and then reattached to the adjustable end structure 128. Accordingly, by reversibly mounting the adjustable height mechanism 56 to the adjustable height mechanism 56, the head structure 148 can be mounted in a higher or lower position similar to those of the high and low mounting positions 156 and 158.

In either the multi-mount or single-mount configuration of the adjustable height mechanism 56, the height variance between the various mounting mechanisms may be selected to extend the electrically actuated arm assembly 54 beyond its minimum and maximum height. For example, if the prospective target objects 14 have a variety of dimensions, such as large-sized and small-sized, then the foregoing height variance can be tailored to the different heights of these differently sized target objects. In an automotive application, the height variance may be chosen to accommodate vehicles ranging from small cars to large trucks. The height variance also may accommodate different object positions, such as lift-mounted, trailer mounted, assembly line mounted, pallet-mounted, and so forth.

Figure 5:
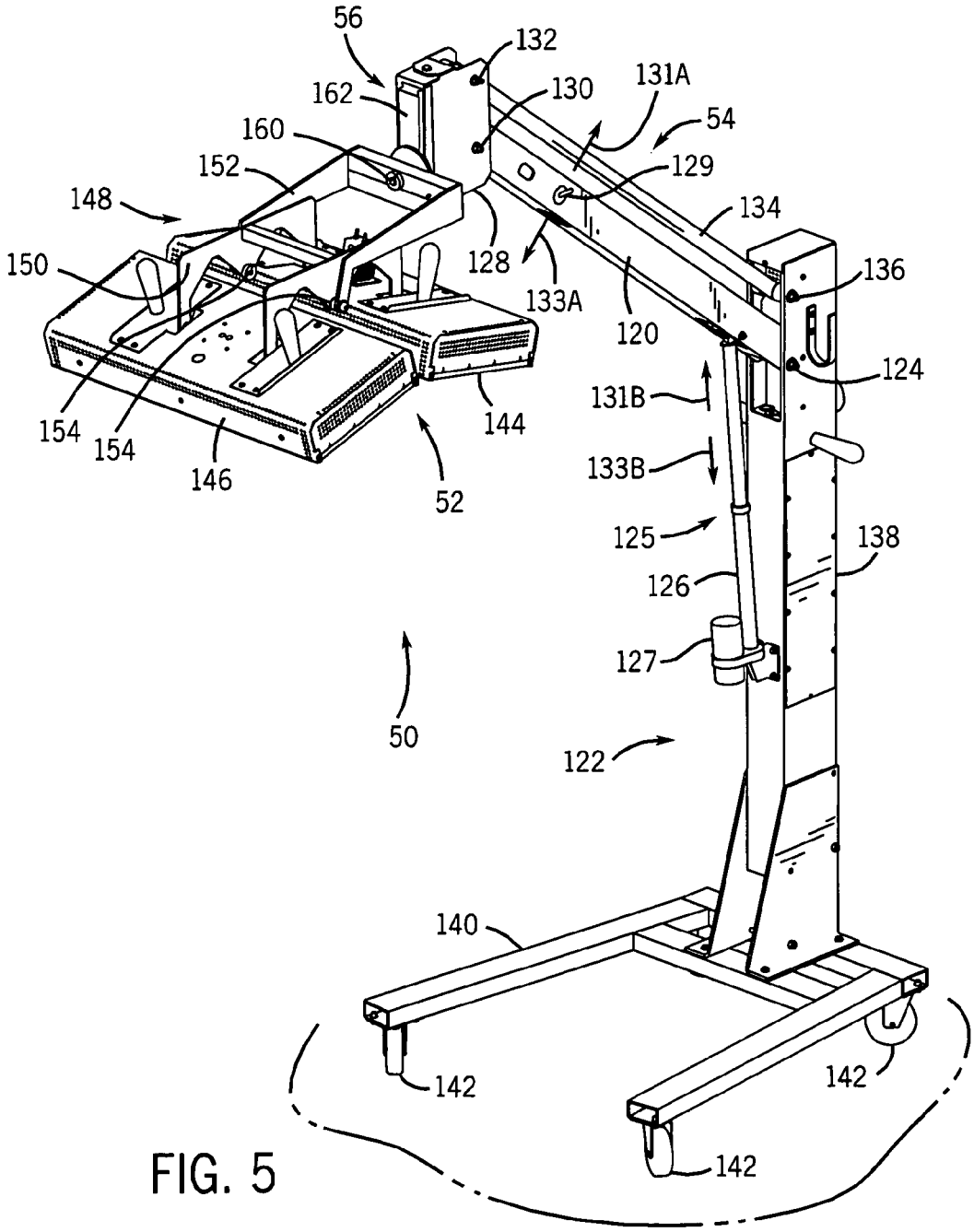
FIG. 5 is a perspective view of an alternative embodiment of the finish curing system illustrated in FIG. 4.

In a further alternative embodiment, the adjustable height mechanism 56 may comprise a linear positioning mechanism 162, as illustrated in FIG. 5. The linear positioning mechanism 162 may have a variety of manual or automatic motion-inducing mechanisms, such as a hydraulic mechanism, a pneumatic mechanism, a geared mechanism, a motorized mechanism, a cable and pulley mechanism, a rail and carrier mechanism, or any other suitable manually or automatically movable mechanism. Again, the vertical range of the linear positioning mechanism 162 may be tailored to the different heights and sizes of the prospective target objects 14.

In operation, the finish curing system 50 can position the head structure 148 and mounted curing device 52 adjacent low and high surfaces of various different target objects 14, such as small and large-sized vehicles. At each of these positions, the heating/drying devices 144 and 146 operate to cure the desired material applied to the surface of the target object 14. Again, the desired material may be a paint, a wax, a filler (e.g., body filler), a fluid or powder sprayed coating material, a brush applied coating material, a clear coat material, or any other suitable surface application materials.

FIGS. 6–9 are side views illustrating exemplary configurations of the finish curing system 50 utilizing the adjustable height mechanism 56 and the motorized drive 125. As discussed above, the actuator or switch 129 (not shown) is engaged to activate the electric motor 126 to move the linear drive 127 in the downward direction 133B or the upward direction 131B, which progressively forces the arm structure 120 to move in a downward direction or an upward direction, respectively. In this manner, the motorized drive 125 moves the arm structure 120, and the curing device 52 mounted thereto, between a minimum height position 164 (see FIGS. 6 and 7) and a maximum height position 174 (see FIGS. 8 and 9). Thus, the motorized drive 125 effectuates the primary powered movement of the arm structure 120 between minimum and maximum height positions 164 and 174. In turn, the adjustable height mechanism 56 provides a range of vertical adjustment of the curing device 52 relative to the outer end of the arm structure 120.

Figure 6:
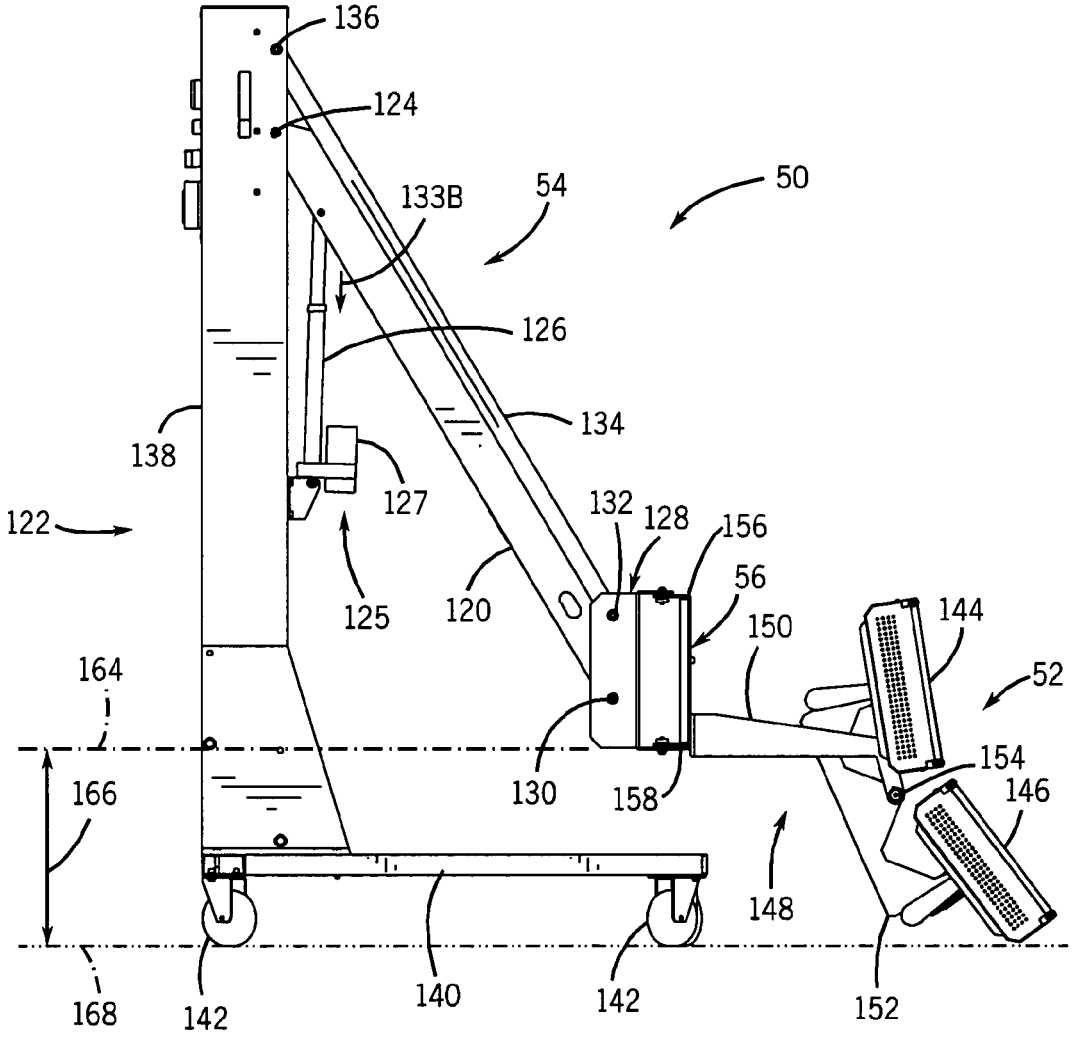
FIGS. 6–9 are side views illustrating different height configurations of the finish curing system illustrated in FIGS. 4 and 5.
Figure 7:
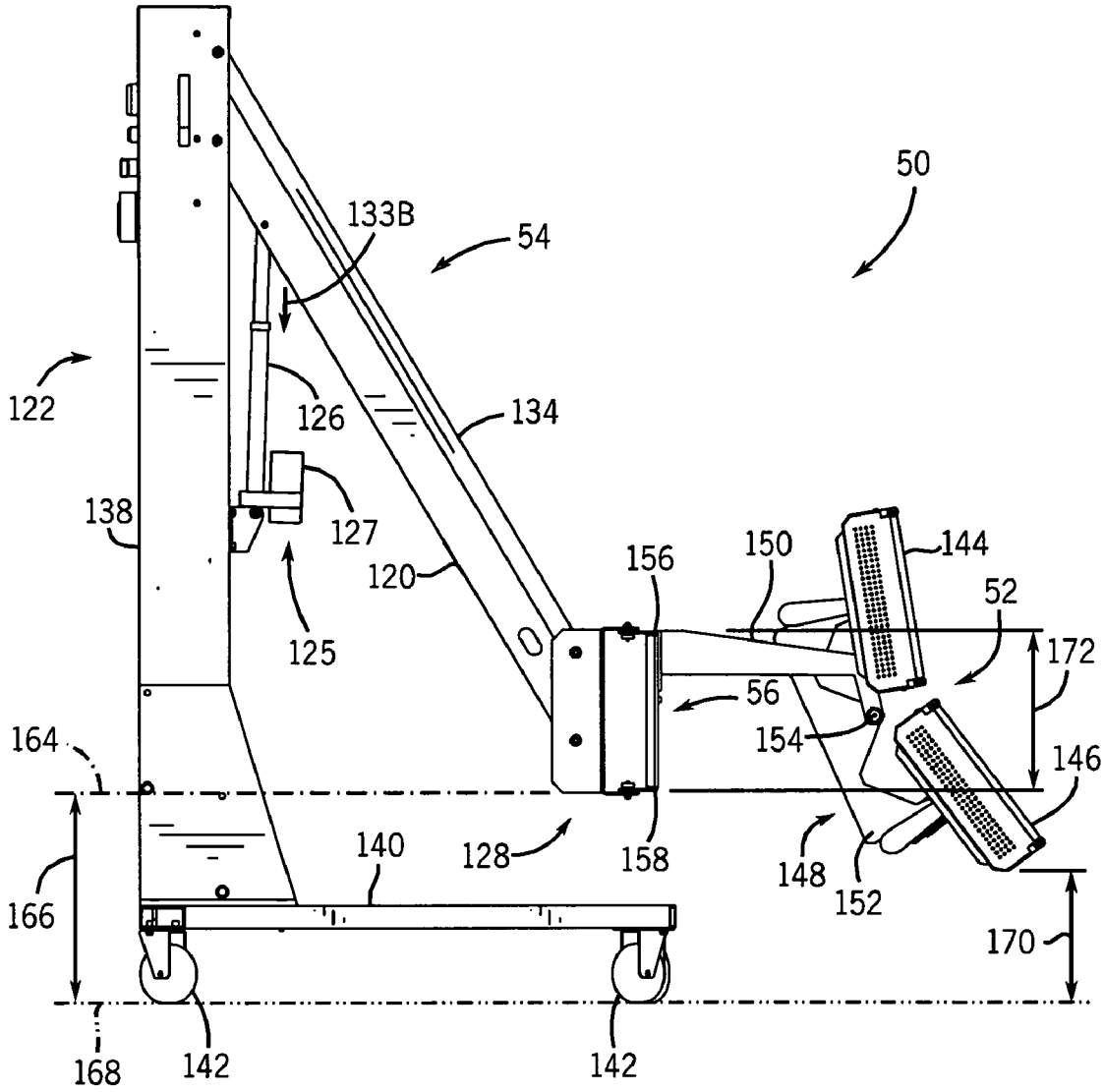

As illustrated in FIGS. 6 and 7, the electrically actuated arm assembly 54 positions the arm structure 120, the head structure 148 and mounted curing device 52 in the minimum height position 164, which is disposed at a vertical distance 166 from a ground position 168. At this minimum height position 164, the adjustable height mechanism 56 vertically adapts the electrically actuated arm assembly 54 to the particular size and position of the target object 14. In the low mounting position 158 of the adjustable height mechanism 56, the curing device 52 is positionable at or below the ground level 168, such that the curing device 52 can cure the desired material at the base of the target object 14. For example, the low mounting position 158 may be particularly advantageous for small-sized vehicles, pallet-mounted vehicles, or other target objects 14 positioned near the ground level 168.

As illustrated in FIG. 7, the adjustable height mechanism 56 also can position the arm structure 120, the head structure 148 and mounted curing device 52 in the high mounting position 156. In the high mounting position 156, the curing device 52 is positioned above the ground level 168 at a vertical height 170, which relates to a vertical offset 172 provided between the high and low mounting positions 156 and 158. Accordingly, the curing device 52 can cure the desired material at the base of a large-sized or high-positioned target object 14, such as a large vehicle, a lift-mounted vehicle, and so forth.

Figure 8:
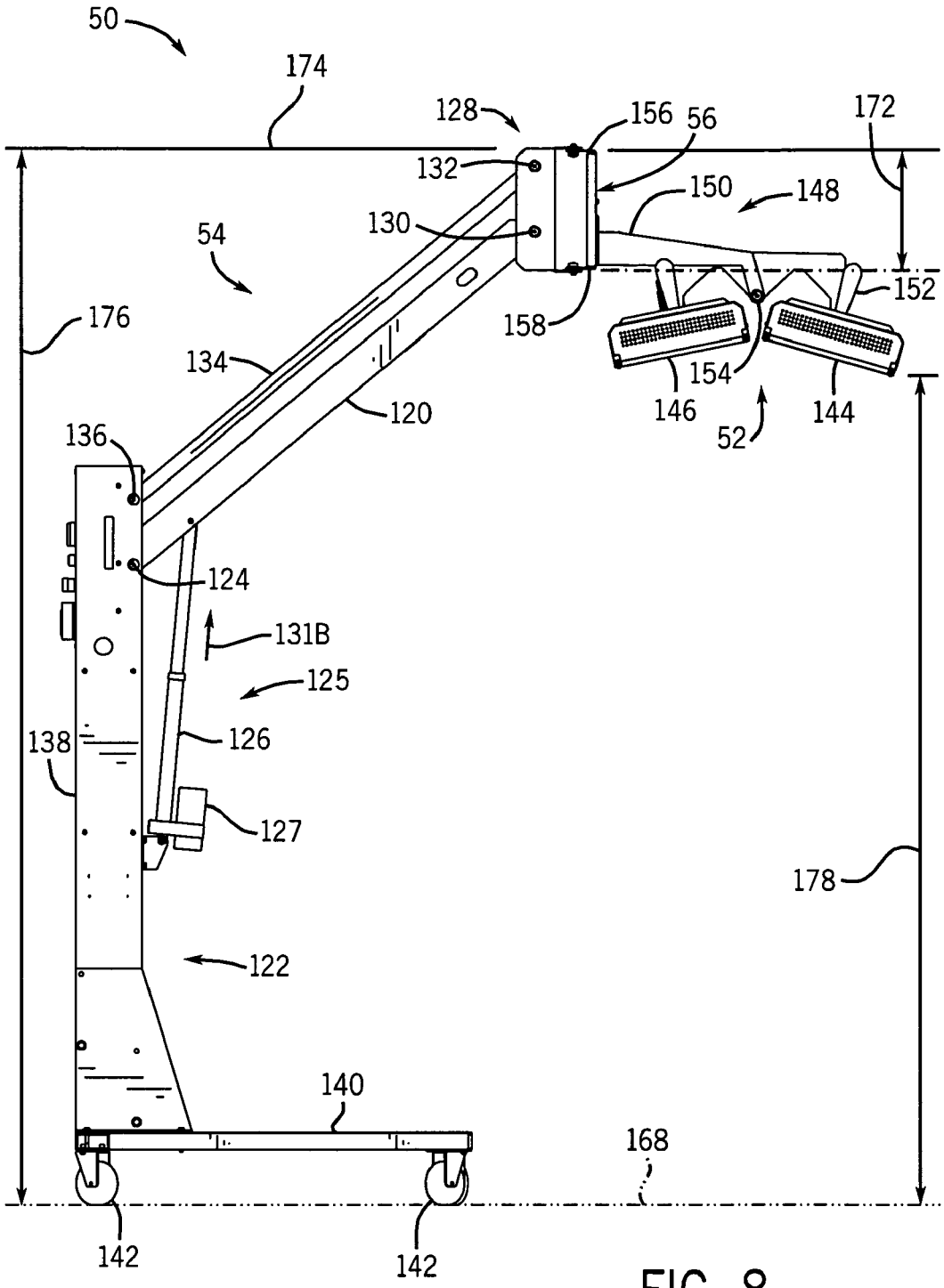
Figure 9:
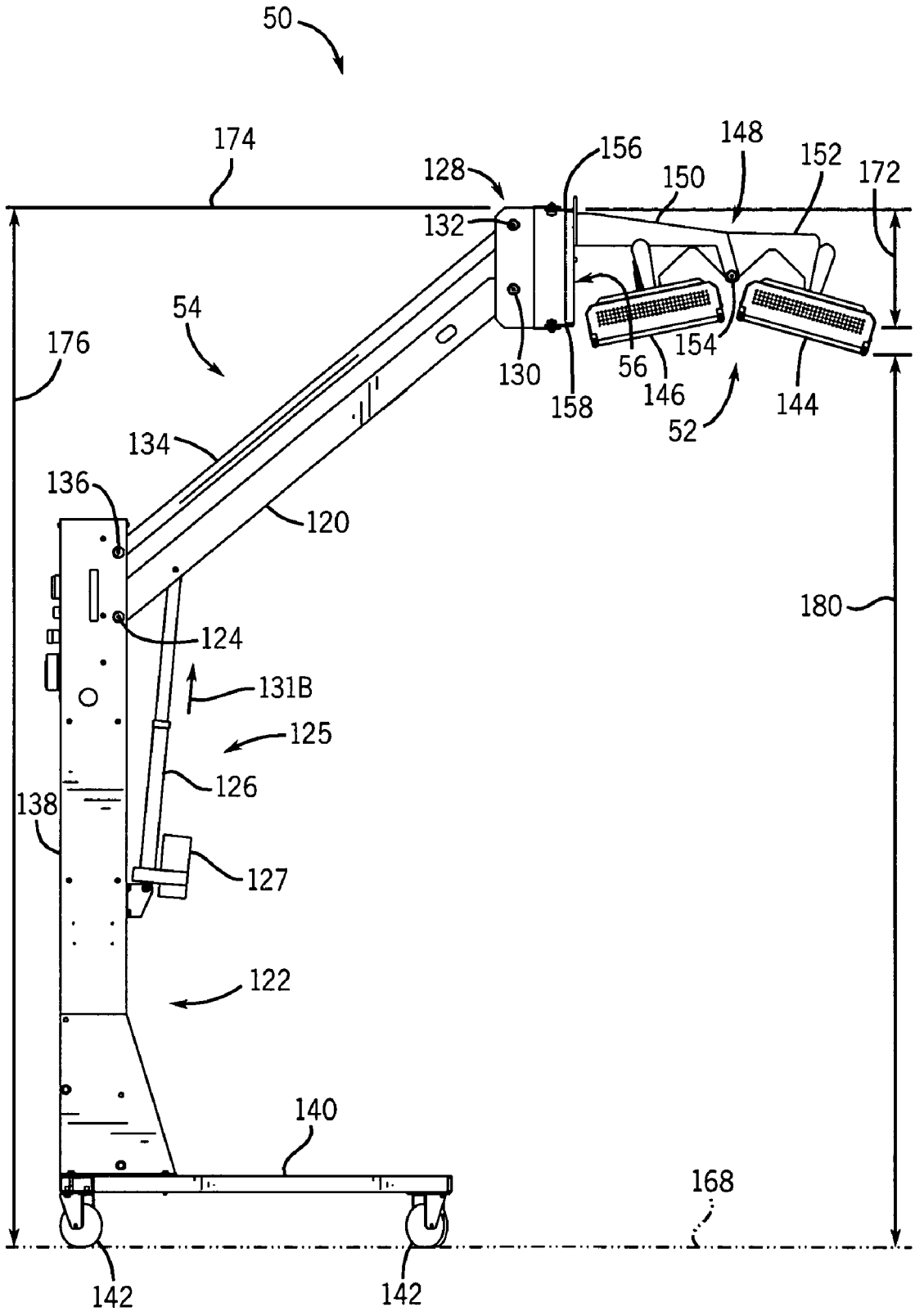

As illustrated in FIGS. 8 and 9, the electrically actuated arm assembly 54 positions the arm structure 120, the head structure 148 and mounted curing device 52 in the maximum height position 174, which disposes the arm structure 120 at a vertical distance 176 from the ground position 168. At this maximum height position 174, the adjustable height mechanism 56 vertically adapts the electrically actuated arm assembly 54 to the particular size and position of the target object 14. The finish curing system 50 also may rotate the curing device 52 to a downwardly facing orientation, which facilitates curing of a desired material disposed on an upper surface of the target object 14. If the target object 14 has a low topside, then the adjustable height mechanism 56 may move the head structure 148 and mounted curing device 52 to the low mounting position 158, as illustrated in FIG. 8. In this low mounting position 158, the heating/drying devices 144 and 146 are offset from the ground level 168 at a vertical distance 178. As described above, the low mounting position 158 may be particularly advantageous for small-sized vehicles, pallet-mounted vehicles, or other low to the ground target objects 14. The adjustable height mechanism 56 also can move the head structure 148 and mounted curing device 52 to the high mounting position 156, as illustrated in FIG. 9. In the high mounting position 156, the heating/drying devices 144 and 146 are disposed at a vertical height 180, which is higher than the vertical height 178 by the vertical offset 172. Accordingly, the curing device 52 can cure the desired material at the topside of a large-sized or high-positioned target object 14, such as a large vehicle, a lift-mounted vehicle, and so forth.

Figure 10:
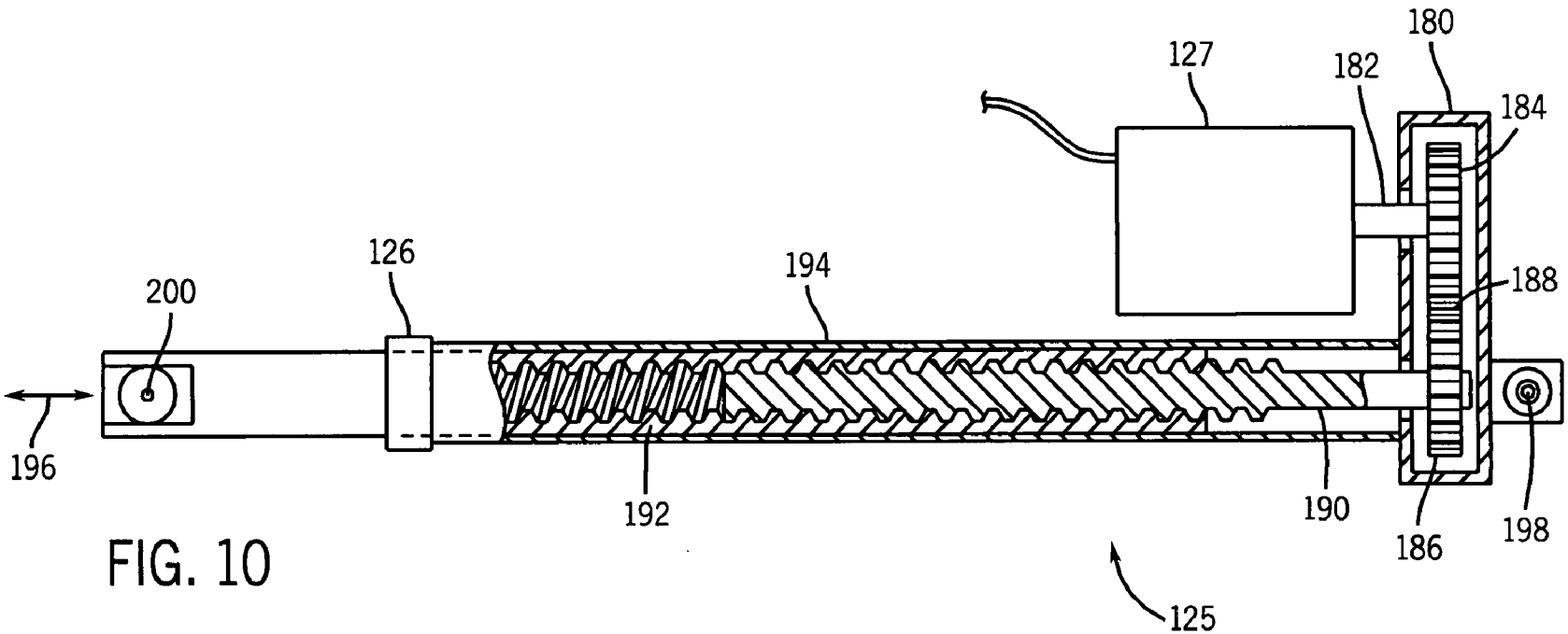
FIG. 10 is a diagram illustrating an exemplary motorized drive for an electrically actuated arm assembly in accordance with embodiments of the present technique.

As discussed above, the motorized drive 125 provides a desired force and range of linear movement to rotate the arm structure 120 relative to the vertical support 138, thereby enabling a user to more easily and quickly reposition the curing device 52 relative to a target object. FIG. 10 is a diagram of the motorized drive 125 in accordance with embodiments of the present technique. In the illustrated embodiment, the motorized drive 125 includes the electric motor 127 coupled to a gear box 180, which is coupled to the linear drive 126. More specifically, the electric motor 127 has a rotating motor shaft 182 coupled to a first gear 184, which engages a second gear 186 at an interface 188 within the gear box 180. In turn, the second gear 186 is coupled to a male worm shaft or externally threaded shaft 190 of the linear drive 126. This externally threaded shaft 190 rotatably engages or threads with internal threads of a moveable drive structure, e.g., a female worm or internally threaded structure 192, disposed slidingly inside a drive enclosure 194. As illustrated, a portion of the female worm 192 remains inside the drive enclosure 194, while a peripheral portion of the female worm 192 moves inwardly and outwardly from an open end of the drive enclosure 194. In addition, alternate embodiments of the motorized drive 125 may have hydraulic or pneumatic systems including pumps, piston and cylinder assemblies, and so forth. Moreover, the motorized drive 125 may include a variety of other power sources and linear positioning systems.

In operation, the electric motor 127 rotates the motor shaft 182 and the first gear 184, which then rotates the second gear 186 and the externally threaded shaft 190. As a result of this rotation, the externally threaded shaft 190 progressively threads the internally threaded structure 192 to provide a linear movement 196 along the length of the drive enclosure 194. Depending on the direction of rotation, the linear movement 196 is either inward or outward, such that the overall linear drive 126 either contracts or expands, respectively. The motorized drive 125 also includes first and second pivot joints 198 and 200, which are configured to connect with the vertical support 188 and the arm structure 120. The connection points for these first and second pivot joints 198 and 200 may vary depending on the desired leverage and range of linear movement 196. For example, the joints 198 and 200 can be connected to the vertical support 188 and the arm structure 120 at a desired offset relative to the pivot joint 124 of the arm structure 120, as illustrated in FIGS. 4–9.

Figure 11:
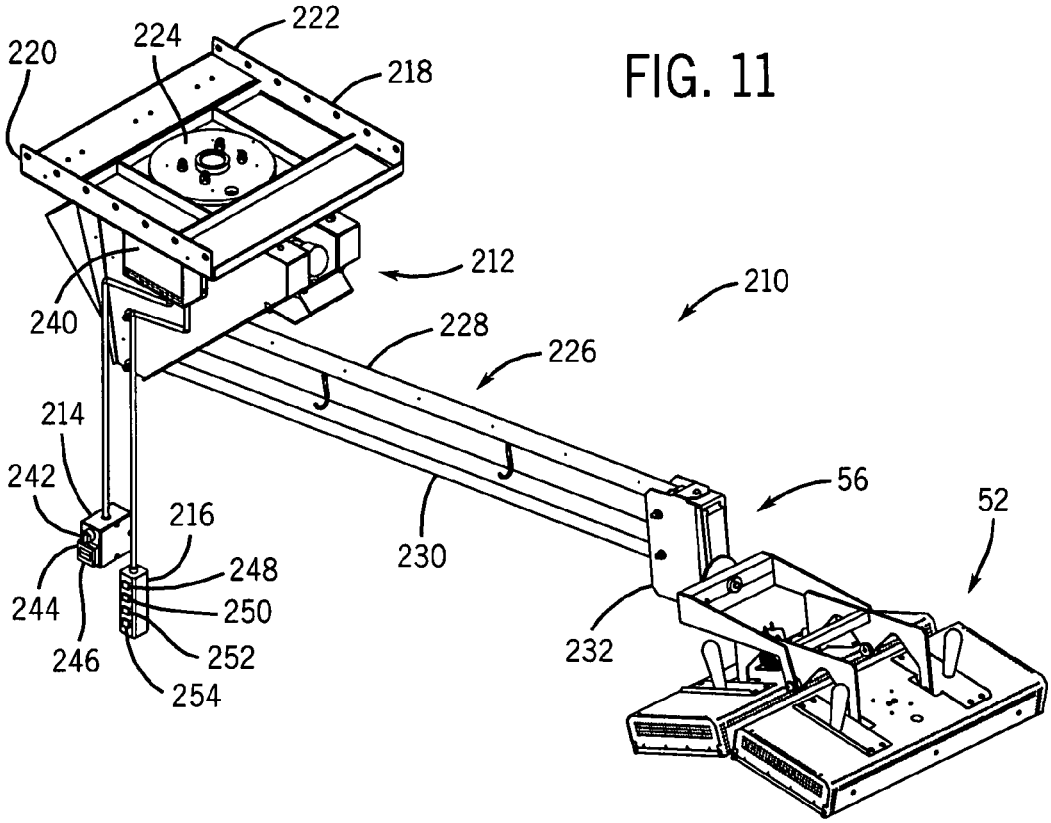
FIG. 11 is a perspective view of an electrically actuated arm assembly of the finish curing system illustrated in FIG. 2 in accordance with alternative embodiments of the present technique.
Figure 12:
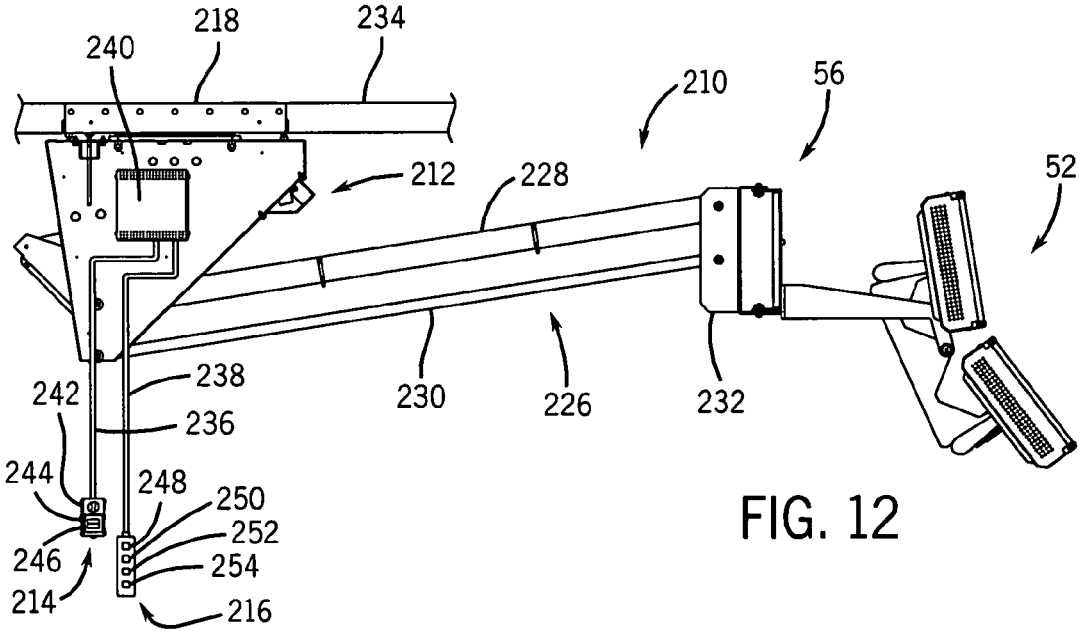
FIG. 12 is a side view of the electrically actuated arm assembly illustrated in FIG. 11.
Figure 13:
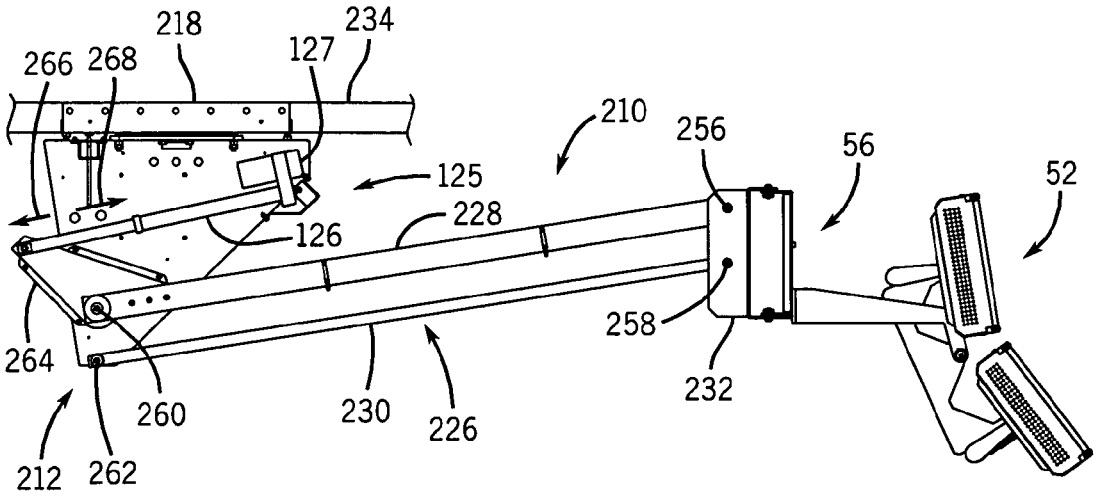
FIG. 13 is a side view of the electrically actuated arm assembly illustrated in FIG. 12 having a portion removed to illustrate interconnectivity with a motorized drive in accordance with alternative embodiments of the present technique.

FIGS. 11, 12, and 13 illustrate an overhead arm assembly 210 having a motorized drive section 212 and remote control units 214 and 216 in accordance with embodiments of the present technique. FIG. 11 is a perspective view of the overhead arm assembly 210 illustrating features of an overhead head mount or rail mounting structure 218. As illustrated, the rail mounting structure 218 includes a pair of flanges or mounting lips 220 and 222 that are configured to mount with an overhead structure, such as a rail, a ceiling, or another structure disposed above the target object. In addition, the overhead mount or rail mounting structure 218 includes a central rotating mechanism 224, which is configured to enable rotation of the overhead arm assembly 210 relative to the flanges or mounting lips 220 and 222. The overhead arm assembly 210 also includes a rotatable arm assembly 226 coupled to the motorized drive section 212. The illustrated arm assembly 226 includes a first arm 228 and a second arm 230, which arms extend outwardly to a head or peripheral portion 232. In turn, the curing device 52 is coupled to the head 232 via an adjustable height mechanism 56, as discussed in detail above. Again, the adjustable height mechanism 56 enables the curing device 52 to be positioned at a variety of vertical positions relative to the head 232. In addition, as discussed in further detail below, the motorized drive section 212 responds to user controls or actuation devices to rotate the arm assembly 226 upward or downward relative to the overhead mount or rail mounting structure 218. For example, the remote control units 214 and 216 include a variety of user controls to operate the motorized drive section 212, the curing device 52, and various other features of the overhead arm assembly 210.

FIG. 12 is a side view of the overhead arm assembly 210 having the overhead mount or the rail mounting structure 218 coupled to an overhead structure or rail mechanism 234 in accordance with embodiments of the present technique. Depending on the particular application, the rail mounting structure 218 may be fixedly or moveably coupled to the rail mechanism 234 at a desired position above the target object having a surface material to be cured by the curing device 52. Accordingly, the remote control units 214 and 216 may include one or more control functions to move the overhead arm assembly 210 along the rail mechanism 234 via hydraulics, pneumatics, a cable and pulley system, or a variety of motorized mechanisms.

In the illustrated embodiment, the remote control units 214 and 216 include wires 236 and 238 leading to a wiring or electronics control box 240 disposed on the motorized drive section 212. As illustrated, the remote control unit 214 includes a knob 242 and buttons 244 and 246, which are configured to control the temperature profile of the curing device 52. In addition, the illustrated remote control unit 216 includes buttons 248, 250, 252, and 254, which may include a cycle start button, a laser start button, an upward movement button, and a downward movement button. For example, the cycle start button may be configured to initiate a curing cycle for curing a coating or surface material disposed on the target object positioned below the overhead arm assembly 210. Moreover, the laser start button may be configured to initiate a sighting laser to facilitate precise positioning of the curing device 52 relative to the surface of the target object. Finally, the upward and downward movement buttons are configured to actuate the motorized drive section 212 to drive or rotate the rotatable arm assembly 226 in an upward or downward direction relative to the overhead mount or rail mounting structure 218.

FIG. 13 is a side view of the overhead arm assembly 210 with a portion of the motorized drive section 212 removed to illustrate the motorized drive 125 coupled to the rotatable arm assembly 226 in accordance with embodiments of the present technique. As illustrated, the first and second arms 228 and 230 are rotatably coupled to the head 232 via pivot joints 256 and 258, respectively. In addition, opposite ends of the first and second arms 228 and 230 are rotatably coupled to the motorized drive section 212 via pivot joints 260 and 262, respectively. In turn, the first arm 228 is coupled to the linear drive 126 of the motorized drive 125 via an intermediate link or leveraging member 264. If the user engages an upward button on the remote control unit 216 (see FIGS. 11 and 12), then the electric motor 127 drives the linear drive 126 in an outward or expansive direction 266, thereby causing the first arm 228 to rotate in a counterclockwise direction effectuating an upward movement of the overhead arm assembly 210 and associated curing device 252. If the user engages a downward button on the remote control unit 216, then the electric motor 127 moves the linear drive 126 in an inward or contracting direction 268, thereby rotating the overhead arm assembly 210 in a clockwise direction to move the curing device 52 in a downward direction. Again, as discussed in detail above, the motorized drive 125 may include a variety of gearing mechanisms, hydraulics, pneumatics, cable and pulley systems, and other suitable power and positioning mechanisms in accordance with embodiments of the present technique.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system for curing a surface material disposed on a vehicle, comprising:

an electrically actuated arm comprising an arm structure, a motorized drive coupled to the arm structure, and an actuator communicatively coupled to the motorized drive, wherein the actuator comprises a directional controller disposed on the electrically actuated arm, the directional controller having an upward direction and a downward direction;

a radiative curing device coupled to the arm structure; and a curing controller communicatively coupled to the radiative curing device.

2. The system of claim 1, wherein the motorized drive comprises a linear drive coupled to an electric motor.

3. The system of claim 1, wherein the motorized drive comprises a worm shaft.

4. The system of claim 1, wherein the directional controller is disposed on an end portion of the electrically actuated arm in general proximity to the radiative curing device.

5. The system of claim 1, wherein the directional controller comprises a remote control unit.

6. The system of claim 1, wherein the electrically actuated arm comprises an overhead mount.

7. The system of claim 6, wherein the overhead mount comprises a rail mount structure.

8. The system of claim 1, wherein the electrically actuated arm comprises a floor mount.

9. The system of claim 1, wherein the radiative curing device comprises an infrared heater.

10. The system of claim 1, wherein the curing controller configured to initiate a selected curing cycle to cure the surface material disposed on the vehicle.

11. A method for curing a surface mate disposed on a vehicle, comprising:

actuating a motorized drive to rotate an arm structure supporting radiative curing device, wherein actuating the motorized drive comprises effectuating a linear force from a first pivot joint on a base structure to a second pivot joint on the arm structure, wherein the first and second joints are both disposed at an offset distance relative to third pivot joint between the arm structure and the base structure; and executing a selected curing cycle on the radiative curing device to cure the surface material disposed on the vehicle.

12. The method of claim 11, wherein actuating the motorized drive comprises initiating the motorized drive to move the arm in an upward direction or a downward direction in response to an upward command or a downward command, respectively.

13. The method of claim 11, wherein actuating the motorized drive comprises responding to a directional control from a remote control unit.

14. The method of claim 11, wherein actuating the motorized drive comprises responding to a directional control signal from a directional controller disposed on a peripheral portion of the arm structure.

15. The method of claim 11, wherein actuating the motorized drive comprises effectuating rotation of an externally threaded shaft relative to internal threads of a movable drive structure.

16. The method of claim 11, wherein executing the selected curing cycle comprises emitting infrared radiation having a time varying profile.

17. A system for curing a surface material disposed on a vehicle, comprising:

a mount structure;

an arm assembly pivotally coupled to the mount structure, wherein the arm assembly comprises:

a first arm member pivotally coupled to the mount structure and a peripheral portion of the arm assembly at first and second pivot joints respectively; and a second arm member pivotally coupled to the mount structure and the peripheral portion of the arm assembly at third and fourth pivot points respectively;

a motorized drive coupled to the arm assembly, wherein the motorized drive comprises an electric motor coupled to a linear drive pivotally coupled to the mount structure at a fifth joint and pivotally coupled to the arm assembly and a sixth joint, wherein the fifth and sixth joints are both offset from the first and third joints;

a remote control unit communicatively coupled to the motorized drive;

an infrared heater pivotally coupled to a peripheral portion of the arm assembly; and a curing controller communicatively coupled to the infrared heater.

18. A system for curing a surface material disposed on a vehicle, comprising:

a mount structure having a vertical support extending from a base structure;

an arm pivotally coupled to the vertical support at a first joint;

a motorized drive coupled to the vertical support and the arm, wherein the motorized drive comprises an electric motor coupled to a linear drive, wherein the linear drive includes first and second elongated portions that linearly expand and contract relative to each other, and wherein the motorized drive includes second and third pivot joints respectively coupled to the vertical support and the arm at an offset from the first joint;

a directional controller communicatively coupled to the motorized drive;

an infrared heater pivotally coupled to a peripheral portion of the arm; and a curing controller communicatively coupled to the infrared heater.

19. The system of claim 17 wherein the first and second arm structures are parallel.

20. The system of claim 18 wherein the directional controller is positioned on the arm.

21. The system of claim 20 wherein the arm comprises a first and second arm pivotally coupled between the infrared heater and the vertical support.

* * * * *